United States Patent [19]

Steiner

[11] 4,024,943

[45] May 24, 1977

[54] MARKING APPARATUS FOR STENOGRAPHIC TYPEWRITER OR THE LIKE

[76] Inventor: Dennis D. Steiner, 4115 Underwood Place, Reno, Nev. 89501

[22] Filed: Jan. 13, 1976

[21] Appl. No.: 648,678

[52] U.S. Cl. ..... 197/180; 197/9; 101/368

[51] Int. Cl.[2] ..... B41J 29/40

[58] Field of Search ..... 197/9, 180, 181; 101/368

[56] References Cited

UNITED STATES PATENTS

| | | | |
|---|---|---|---|
| 924,215 | 6/1909 | Andrews | 197/181 |
| 1,559,771 | 11/1925 | Padman | 197/180 |
| 2,777,824 | 1/1957 | Leeds | 101/368 |
| 2,834,949 | 5/1958 | Siskind | 197/181 |
| 2,847,104 | 8/1958 | Seghi | 197/9 |
| 3,147,840 | 9/1964 | Brookhouser | 197/180 |
| 3,432,018 | 3/1969 | Watanabe et al. | 197/180 |
| 3,506,749 | 4/1970 | Weissman | 101/368 |
| 3,547,247 | 12/1970 | Twyford | 197/180 |
| 3,869,981 | 3/1975 | Davis | 101/109 |

*Primary Examiner*—Edgar S. Burr
*Assistant Examiner*—William Pieprz
*Attorney, Agent, or Firm*—Littlepage, Quaintance

[57] ABSTRACT

A marking apparatus for use with a mechanical symbol transcribing apparatus such as a stenographic typewriter comprises a lever having a marking means attached to one end of the lever for marking the web or tape carrying the record generated by the apparatus. The other end of the lever is an enlarged contact area adapted for manual digital engagement. A fulcrum means located between the two ends of the lever pivotally supports the lever. An attachment means attaches the fulcrum means to the transcribing apparatus such that the first end is located above the keyboard of the apparatus and the second end is located above the record generated by the apparatus.

5 Claims, 3 Drawing Figures

MARKING APPARATUS FOR STENOGRAPHIC TYPEWRITER OR THE LIKE

BACKGROUND OF THE INVENTION

1. Field of the Invention

This invention relates generally to a marking attachment for use with a mechanical symbol transcribing apparatus manually operated from a keyboard such as calculating machines and typewriters. The apparatus has particular utility with stenographic typewriters which generate a permanent record on a web such as a paper tape being moved lengthwise through the apparatus.

2. Description of the Prior Art

Stenographic typewriters also known as stenotype machines are extensively used to record the testimony and remarks made during court proceedings, administrative hearings, and the like. The operator of the stenographic typewriter attempts to record the exact words of conversation taking place among the several persons present and must do so rapidly and accurately. It is occasionally necessary that a later ready reference be made to such things as direct and cross examination, exhibits, and unfamiliar words and terms. In the absence of any marking apparatus in the general class as that of this invention, the operator must remove his hand from the keyboard of the apparatus, pick up a pin, pencil or the like, and manually mark the record. During this marking process, testimony can easily be lost especially if the conversation is occurring at a fast pace.

It is therefore the object of this invention to provide a marker for a stenographic typewriter or the like which will apply a reference mark on the record created by the typewriter while it is being operated without moving the hands from the region of the keyboard.

Prior attempts to create devices within this class are to be found in U.S. Pats. Nos. 2,823,784, 2,847,104 and 3,213,995. A common shortcoming of each of the foregoing markers is the presence of unwieldy, complicated mechanisms wholly unnecessary to achieve the desired result.

It is an object of this invention to provide a marker for a stenographic typewriter or the like which is exceedingly simple in construction and easily adapted to the various habits and practices of the operator.

SUMMARY OF THE INVENTION

The marking element according to this invention comprises generally a lever having a first end adapted to be positioned adjacent to the keyboard of a mechanical symbol transcribing apparatus. The lever has a second end adapted to be positioned adjacent to a web carrying the record generated by the apparatus, the second end having a marking means attached thereto for marking the web. The lever is pivotally supported by a fulcrum means for movement in a substantially vertical plane. An attachment means attaches the fulcrum means to the transcribing apparatus in such a position as to locate the first end of the lever above the keyboard of the apparatus and the second end of the lever over the web. The first end of the lever can have sufficient mass to insure the marking means will be free from contact with the web carrying the record except when the first end is manually deflected upward.

Additional mass can be attached to the first end of the lever to insure proper balance of the marking element. In one embodiment, the attachment means comprises a complementary pair of adhesive pile strips, one strip being fixed to the bottom of the fulcrum means and the second strip being fixed to the surface of the case enclosing the transcribing apparatus. An example of adhesive pile strips suitable for use as the attachment means is the adhesive pile material marketed under the trademark VELCRO.

Preferably the first end of the lever comprises a contact area larger in width than the remaining portion of the lever for facilitating manual operation of the lever. If the marking element is made of a cast thermoplastic or thermoset resin, the fulcrum means most advantageously comprises a narrowed region of a strip of the resin adjoining the lower side of the lever thereby forming a hinge. The marking means attached to the second end of the lever for marking an ink impression on the record can comprise a segment of a microporous, microreticulated resin or the like containing an ink. An example of a material suitable for use is one made according to the process of U.S. Pat. No. 2,777,824 and improvements thereon marketed under the trademark PORELON.

When in use a marking element according to this invention is positioned on the case enclosing the transcribing apparatus between the keyboard of the apparatus and the tape or web carrying the record generated. The operator need only make a small upward motion of a finger from the position normally assumed over the keyboard of the apparatus in order to deflect the first end of the lever upward thus making the marking means attached to the second end of the lever come in contact with the web. The operation, structural features and advantages will become more apparent from a study of the following description of the invention taken in connection with the accompanying figures.

DESCRIPTION OF THE PREFERRED EMBODIMENT

Figure 1:
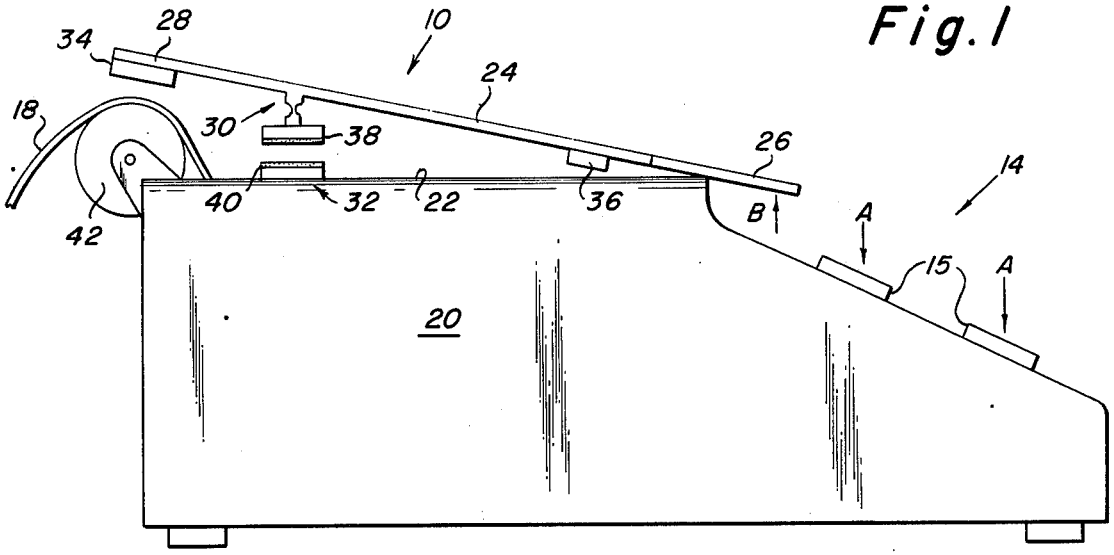
FIG. 1 is a schematic representation of the essential features of the marking element according to this invention in use with a mechanical symbol transcribing apparatus.
Figure 2:
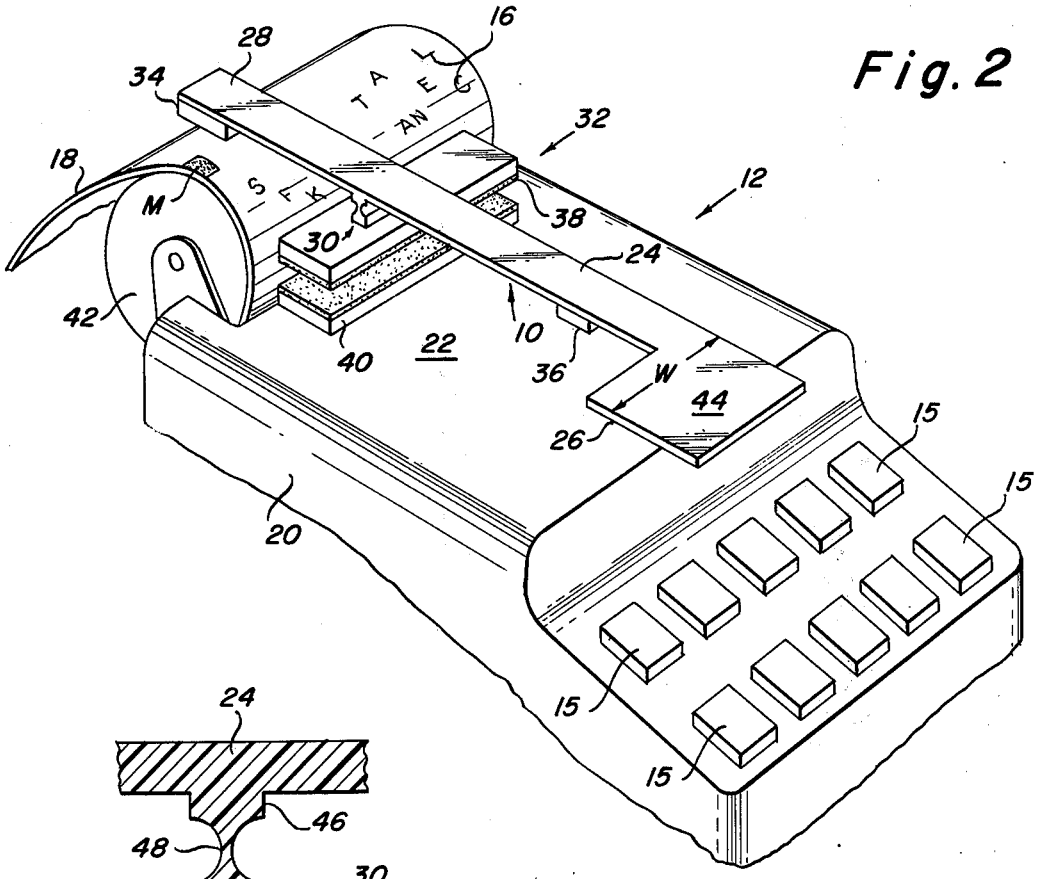
FIG. 2 is a perspective view of a marking element according to this invention incorporating some of the preferred features of the invention.
Figure 3:
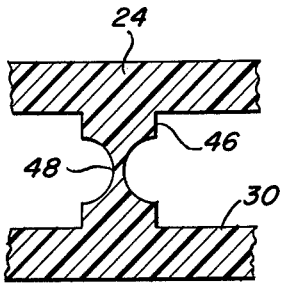
FIG. 3 is a sectional detailed view of a preferred embodiment of the lever and fulcrum means.

Each of the analogous portions of the several arrangements of the apparatus according to this invention illustrated in FIGS. 1 through 3 are referred to by common numerals to indicate common portions. The marking element 10 according to this invention is designed for use with any mechanical symbol transcribing apparatus 12 which is manually operated from a keyboard 14 typically by depressing the individual keys 15 in the direction A. The symbol transcribing apparatus 12 is adapted to generate a permanent record of symbols 16 on a web 18, typically paper, being moved lengthwise through the apparatus 12 over a web support 42 which may be a bar, roll or roller. The apparatus 12 further comprises a case 20 having a surface 22 positioned between the keyboard 14 and the web 18.

The marking element 10 generally comprises a lever 24 having a first end 26 adapted to be positioned adjacent to the keyboard 14 of a transcribing apparatus 12 and a second end 28 adapted to be positioned adjacent to the web 18 carrying the record 16 generated by the apparatus 12. The marking element 10 also comprises a fulcrum means 30 for pivotally supporting the lever 24 for movement in a substantially vertical plane. Further comprising the marking element is an attachment means 32 for attaching the fulcrum means to a transcribing apparatus 12. The fulcrum means 30 is attached to surface 22 of the case 20 in such a manner as to suitably position the lever 24 such that the first end 26 is located above the keyboard 14 and the second end 28 is located above the web 18.

The second end 28 of the lever 24 has a marking means 34 attached thereto for marking the web 18 with ink. The marking means 34 can comprise any suitable means for applying ink to the surface of a web typically made of paper. In a preferred embodiment the marking means comprises a generally right rectangular segment of a microporous or microreticulated resin or the like containing an ink.

The first end 26 of the lever 24 is preferably of sufficient mass to insure that the marking means 34 will be free from contact with the web 18 except when the first end 26 is manually deflected upward in a direction B. An additional mass 36 can be attached to the first end 26 of the lever 24 for insuring proper balance to the marking element 10. In a preferred embodiment the first end 26 of the lever 24 comprises a contact area 44 which is larger in width W than the remaining portion of the lever 24 for facilitating the manual operation of the marking element 10. In this manner a short upward movement of a finger of the operator from the position normally assumed over the keyboard deflects the contact area 44 and first end 26 upwardly in the direction B thus causing the marking means 34 to come in contact with the web 18, the marking means 34 leaving an ink impression M on the web 18. In order that the mark M placed on the web 18 is sufficiently definitive and unambiguous, it is preferred that a web supporting means 42 support the web 18 in the region where contact between the marking means 34 and the web 18 is to be expected.

In one embodiment the attachment means 32 comprises a complementary pair of adhesive pile strips, a first strip 38 being fixed to the bottom of the fulcrum means 30 and a second strip 40 being fixed to the surface 22 of the case 20. The attachment means 32 can also comprise a strip of tape having two adhesive surfaces or any other suitable means for attaching the fulcrum means 30 to the transcribing apparatus 12.

The marking element 10 and each of its constituent parts can be made of any convenient suitable material. Since the apparatus is simply and cleanly designed, unlike the prior art, it lends itself to being manufactured by casting a thermoset or thermoplastic resin in the desired shape to incorporate as a single element the lever 24, first end 26, second end 28, and fulcrum means 30. When so constructed, the fulcrum means 30 further comprises a strip 46 of the resin adjoining the lower side of the lever 24 having a narrowed region 48 forming a hinge. The narrowed region 48 had dimensions selected according to well-known resin casting technology to afford maximum flexibility and long term wear.

Although the invention has been described in considerable detail with reference to certain preferred embodiments thereof, it will be understood that variations and modifications can be effected within the spirit and scope of the invention as described above and as defined in the appended claims.

What is claimed is:

1. A marking element for use with a mechancial symbol transcribing apparatus manually operated from a keyboard, the apparatus adapted to generate a permanent record on a web being moved lengthwise through the apparatus, the apparatus comprising a case having a surface positioned between the keyboard and the web, the novel marking element comprising a lever having a first end adapted to be positioned adjacent to the keyboard and a second end adapted to be positioned adjacent to the web, a fulcrum means located between the first and second ends of the lever for pivotally supporting the lever for movement in a substantially vertical plane, the fulcrum means comprising a strip adjoining a lower side of the lever, the strip having an advantageously narrowed region forming a hinge, an attachment means for attaching the fulcrum means to said surface in such a manner as to suitably position the lever such that the first end is located above the keyboard and the second is located above the web, the attachment means comprising a complementary pair of adhesive pile strips, and marking means attached to the second end of the lever for marking the web, the first end of the lever being sufficiciently massive to ensure that the marking means will be free from contact with the web except when the first end is manually deflected upward.

2. The combination of a mechanical symbol transcribing apparatus manually operated from a keyboard, the apparatus adapted to generate a permanent record on a web being moved lengthwise through the apparatus and compising a case having a surface positioned between the keyboard and the web, and a lever having a first end and a second end, a fulcrum means for pivotally supporting the lever for movement in a substantially vertical plane, a complementary pair of adhesive pile strips, one strip being fixed to the bottom of the fulcrum means and the second strip being fixed to the surface of the case for attaching the fulcrum means to said surface of the apparatus in such a manner as to suitably position the lever such that the first end is located above the keyboard and the second end is located above the web, and marking means attached to the second end of the lever for marking the web, the first end of the lever being sufficiently massive to insure that the marking means will be free from contact with the web except when the first end is manually deflected upward and wherein the first end of the lever comprises a contact area larger in width than the remaining portion of the lever for facilitating manual operation of the marking element.

3. The combination of claim 2 wherein the fulcrum means comprises a strip integral with the lower side of the lever, the strip having an advantageously narrowed region forming a hinge and wherein the marking means comprises a segment of a microporous, microreticulated resin or the like containing an ink.

4. A marking element for use with a mechanical symbol transcribing apparatus manually operated from a keyboard, the apparatus adapted to generate a permanent record on a web being moved lengthwise through the apparatus, the apparatus comprising a case having a surface positioned between the keyboard and the web, the novel marking element comprising a lever having a first end adapted to be positioned adjacent to the keyboard and a second end adapted to be positioned adjacent to the web, a fulcrum means for pivotally supporting the lever for movement in a substantially vertical plane, a complementary pair of adhesive pile strips, one strip being fixed to the bottom of the fulcrum means and the second strip being fixed to the surface of the case for attaching the fulcrum means to said surface in such a manner as to suitably position the lever such that the first end is located above the keyboard and the second is located above the web, and marking means attached to the second end of the lever for marking the web, the first end of the lever being sufficiently massive to ensure that the marking means will be free from contact with the web except when the first end is manually deflected upward.

5. A marking element for use with a mechanical symbol transcribing apparatus manually operated from a keyboard, the apparatus adapted to generate a permanent record on a web being moved lengthwise through the apparatus, the apparatus comprising a case having a surface positioned between the keyboard and the web, the novel marking element comprising a lever having a first end adapted to be positioned adjacent to the keyboard and a second end adapted to be positioned adjacent to the web, a fulcrum means comprising a strip integral with the lower side of the lever, the strip having an advantageously narrowed region forming a hinge for pivotally supporting the lever for movement in a substantially vertical plane an attachment means for attaching the fulcrum means to said surface in such a manner as to suitably position the lever such that the first end is located above the keyboard and the second is located above the web, and marking means attached to the second end of the lever for marking the web, the first end of the lever being sufficiently massive to ensure that the marking means will be free from contact with the web except when the first end is manually deflected upward.

* * * * *